US009157696B2

(12) United States Patent
Dextraze

(10) Patent No.: US 9,157,696 B2
(45) Date of Patent: Oct. 13, 2015

(54) FIREARM RAIL ASSEMBLY

(71) Applicant: Serge Dextraze, St-Jean-sur-Richelieu (CA)

(72) Inventor: Serge Dextraze, St-Jean-sur-Richelieu (CA)

(73) Assignee: Cadex, Inc. (CA)

( * ) Notice: Subject to any disclaimer, the term of this patent is extended or adjusted under 35 U.S.C. 154(b) by 0 days.

(21) Appl. No.: 14/201,968

(22) Filed: Mar. 10, 2014

(65) Prior Publication Data

US 2015/0007476 A1 Jan. 8, 2015

Related U.S. Application Data

(60) Provisional application No. 61/781,922, filed on Mar. 14, 2013.

(51) Int. Cl.

| | |
|---|---|
| ***F41C 23/16*** | (2006.01) |
| ***F41G 11/00*** | (2006.01) |
| ***F41A 3/66*** | (2006.01) |

(52) U.S. Cl.

CPC . *F41C 23/16* (2013.01); *F41A 3/66* (2013.01); *F41G 11/003* (2013.01)

(58) Field of Classification Search

CPC ..... F41G 11/003; F41G 11/02; F41C 23/16; F41C 23/04; F41C 23/14

USPC ..... 42/71.01–75.1

See application file for complete search history.

(56) References Cited

U.S. PATENT DOCUMENTS

| | | | | |
|---|---|---|---|---|
| 5,590,484 | A * | 1/1997 | Mooney et al. | 42/111 |
| 5,711,102 | A * | 1/1998 | Plaster et al. | 42/71.01 |
| 6,671,990 | B1 * | 1/2004 | Booth | 42/75.01 |
| 6,694,660 | B1 * | 2/2004 | Davies | 42/75.01 |
| 6,839,998 | B1 * | 1/2005 | Armstrong | 42/71.01 |
| 7,131,228 | B2 * | 11/2006 | Hochstrate et al. | 42/75.01 |
| 7,152,355 | B2 * | 12/2006 | Fitzpatrick et al. | 42/73 |
| 7,458,179 | B2 | 12/2008 | Swan | |
| 7,716,865 | B2 * | 5/2010 | Daniel et al. | 42/75.02 |
| 7,793,452 | B1 * | 9/2010 | Samson et al. | 42/72 |
| 7,802,392 | B2 | 9/2010 | Peterson et al. | |
| 7,905,041 | B1 * | 3/2011 | Davies | 42/75.02 |
| 7,975,419 | B2 * | 7/2011 | Darian | 42/84 |
| 8,205,373 | B1 * | 6/2012 | Ubl et al. | 42/71.01 |
| 8,429,844 | B2 * | 4/2013 | Dextraze et al. | 42/73 |
| 8,522,465 | B2 * | 9/2013 | Jarboe et al. | 42/16 |
| 8,707,606 | B2 * | 4/2014 | Hoel | 42/90 |

(Continued)

OTHER PUBLICATIONS

MilitaryTimes blog post, http://blogs.militarytimes.com/gearscout/2011/09/28/remingtons-lwracs-could-be-an-upgrade-for-the-usmc-m40/, Sep. 28, 2011.

(Continued)

*Primary Examiner* — Michael David

(74) *Attorney, Agent, or Firm* — FisherBroyles, LLP; Anthony J. DoVale

(57) ABSTRACT

A modular rail assembly for supporting accessories upon a modular weapons platform. The modular rail assembly includes a fore rail preferably positioned above the foretube, and an aft rail preferably positioned above the receiver, which cooperate with one another to enable a modular system whereby one rail may be removed or replaced without affecting the other rail and any accessories mounted thereon. One rail defines a mating member and the other rail defines a mating channel for receipt of the mating member. The rail assembly configuration provides increased flexibility and interchangeability to the modular weapons platform.

49 Claims, 11 Drawing Sheets

(56) References Cited

U.S. PATENT DOCUMENTS

| | | | | |
|---|---|---|---|---|
| 8,726,557 | B2 * | 5/2014 | Stone et al. | 42/71.01 |
| D709,582 | S * | 7/2014 | Geissele | D22/108 |
| 8,819,980 | B2 * | 9/2014 | Geissele | 42/71.01 |
| 8,844,185 | B2 * | 9/2014 | Jarboe | 42/73 |
| 8,955,245 | B2 * | 2/2015 | Chvala | 42/73 |
| 2005/0241211 | A1 * | 11/2005 | Swan | 42/124 |
| 2006/0010749 | A1 * | 1/2006 | Kincel | 42/71.01 |
| 2006/0236582 | A1 * | 10/2006 | Lewis et al. | 42/73 |
| 2006/0242880 | A1 * | 11/2006 | Griffin | 42/73 |
| 2006/0277810 | A1 * | 12/2006 | Leitner-Wise | 42/75.03 |
| 2007/0199225 | A1 * | 8/2007 | Haugen | 42/85 |
| 2007/0289190 | A1 * | 12/2007 | Oz | 42/73 |
| 2008/0028662 | A1 * | 2/2008 | Abraham et al. | 42/73 |
| 2008/0168695 | A1 * | 7/2008 | Nakayama | 42/75.02 |
| 2009/0288324 | A1 * | 11/2009 | Peterson et al. | 42/75.03 |
| 2010/0126054 | A1 * | 5/2010 | Daniel et al. | 42/71.01 |
| 2010/0186278 | A1 * | 7/2010 | Daniel | 42/71.01 |
| 2010/0192444 | A1 * | 8/2010 | Cabahug et al. | 42/71.02 |
| 2011/0016762 | A1 * | 1/2011 | Davies | 42/75.01 |
| 2011/0061281 | A1 * | 3/2011 | Kapusta et al. | 42/71.01 |
| 2011/0131858 | A1 * | 6/2011 | Darian | 42/90 |
| 2011/0247254 | A1 * | 10/2011 | Barnes | 42/71.01 |
| 2014/0075815 | A1 * | 3/2014 | Jarboe | 42/73 |
| 2014/0360074 | A1 * | 12/2014 | Jarboe | 42/73 |

OTHER PUBLICATIONS

Photograph of Accuracy ax308, publicly available at least as early as Jan. 2011.

Ashbury Inernational Brochure, ASW338LM, date unknown, at least prior to Mar. 14, 2013.

* cited by examiner

FIREARM RAIL ASSEMBLY

CROSS REFERENCE TO RELATED APPLICATIONS

This application claims the benefit of U.S. Provisional Patent App. Ser. No. 61/781,922 filed Mar. 14, 2013.

FIELD OF THE INVENTION

The present disclosure relates generally to firearms, and more particularly to a modular rail assembly for cooperating with a firearm to support mounted firearm accessories.

BACKGROUND OF THE INVENTION

Modern firearms, including those employed in military and law enforcement applications, often include various accessories to assist the shooter. Such devices may be mounted directly to the firearm or indirectly on a mount associated with the firearm. Conventional mounts include securing accessories to the firearm with a Picatinny rail. A Picatinny rail is a bracket used on firearms in order to provide a standardized mounting platform for accessories and attachments, such as scopes. These rails generally include a single rail extending along the upper surface of the firearm and typically extend at least over the receiver and barrel portions of the firearm. The rail comprises a series of ridges with a T-shaped cross-section interspersed with flat "spacing slots". Accessories are mounted by sliding them on from one end or the other, by means of a clamp, or onto the slots between the raised sections.

A single rail system has been effective for its intended purpose for traditional rifle stocks. It is desirable, however, to provide modular, user configurable tactical firearms that can be adapted to meet a variety of environmental, operational and/or user preference requirements. An example of a prior art modular firearm is disclosed in U.S. Pat. No. 7,802,392 B2. A preferable configurable, tactical firearm is Applicants' modular chassis weapons platform set forth in U.S. Pat. No. 8,429,844 (U.S. application Ser. No. 13/184,501), the disclosure of which is hereby incorporated by reference. Each of these modular weapons platforms employs a single rail assembly. Although a single rail assembly effectively achieves its intended purposes, such as effective accessory mounting for a modular weapons platform, it does not provide configurable or interchangeable features akin to the desirable features of the modular weapons platform upon which it is mounted. Prior art single rail systems do not facilitate the additional felixibility of using a modular weapons platform with a modular rail assembly according to the present invention.

SUMMARY OF THE INVENTION

The present invention overcomes shortcomings of prior art rail systems and provides a modular rail assembly used in combination with a modular weapons platform or traditional rifle stock. In contrast to the prior art rails, the rail assembly disclosed herein includes at least two cooperating rail portions forming a discontinuous, i.e., sectional, rail for connection to a modular weapons platform (or traditional rifle stock) and for supporting accessories thereon. The rail assembly includes an upper surface preferably having the Picatinny configuration.

The modular rail assembly includes at least an aft rail preferably positioned above the receiver, and a fore rail preferably positioned above the foretube, which cooperate with one another to enable a modular system whereby one rail may be removed or replaced without affecting the other rail and any accessories mounted thereon. For example, a scope may be mounted on the aft rail and the fore rail may be removed or replaced with another fore rail without affecting the scope. That is, the scope is not removed and, therefore, will remain properly positioned or "zeroed". In the case of prior art rail systems, the entire rail would be removed and the scope would then need to be "rezeroed". Similarly, other portions of the modular weapons platform such as the action, the barrel, the buttstock, etc., may be removed without necessarily impacting each of the rails of the rail assembly. The novel configuration of the fore and aft rails and the cooperation between the rails results in advantageous recoil and other force containment. While not intending to be bound by any particular theory, the two-piece (or more) design described herein provides a discontinuous surface wherein dissipation of recoil or other forces is interrupted or lessened by the modular configuration of the rail assembly. With a single rail, these forces dissipate along the entire length of the rail, thereby possible impacting accessories mounted thereon. The novel use of a modular connection between the fore and aft rails according to the present invention provides a break between the rails which facilitates flexing or relative movement of one rail relative to the other due, at least in part, to tolerances there between.

Moreover, the ability to remove only one rail, that is, a portion of the rail assembly, provides additional configurability to the weapons platform. For example, if the fore rail is removed, portions of the weapons platform may be removed without affecting the aft rail or any accessories, such as a scope, mounted thereon. The novel configuration of the rail assembly according to the present invention also enables the weapons platform to be used with foretubes (through which the barrel extends) of varying lengths. Another exemplary benefit is that other portions of the weapons platform, such as the receiver and the barrel, may be removed without removing one of the rails leaving all accessories mounted thereon in position. Alternatively, one rail of the rail assembly may be substantially permanently affixed (that is, not intended to be readily removed) to or be integral to a portion of the weapons platform, for example the receiver, and the modularity is achieved by providing a modular additional rail, for example a fore rail, that cooperates with the permanently affixed rail.

DETAILED DESCRIPTION OF THE INVENTION

The present invention will be described in detail with reference to the accompanying drawings. It is to be understood, however, that this invention is not limited to the specific systems, devices, and/or methods disclosed unless otherwise specified, as such can, of course, vary. It is also to be understood that the terminology used herein is for the purpose of describing particular aspects only and is not intended to be limiting. Thus, the following description is provided as illustrative of the principles of the present invention and not in limitation thereof.

Figure 1:
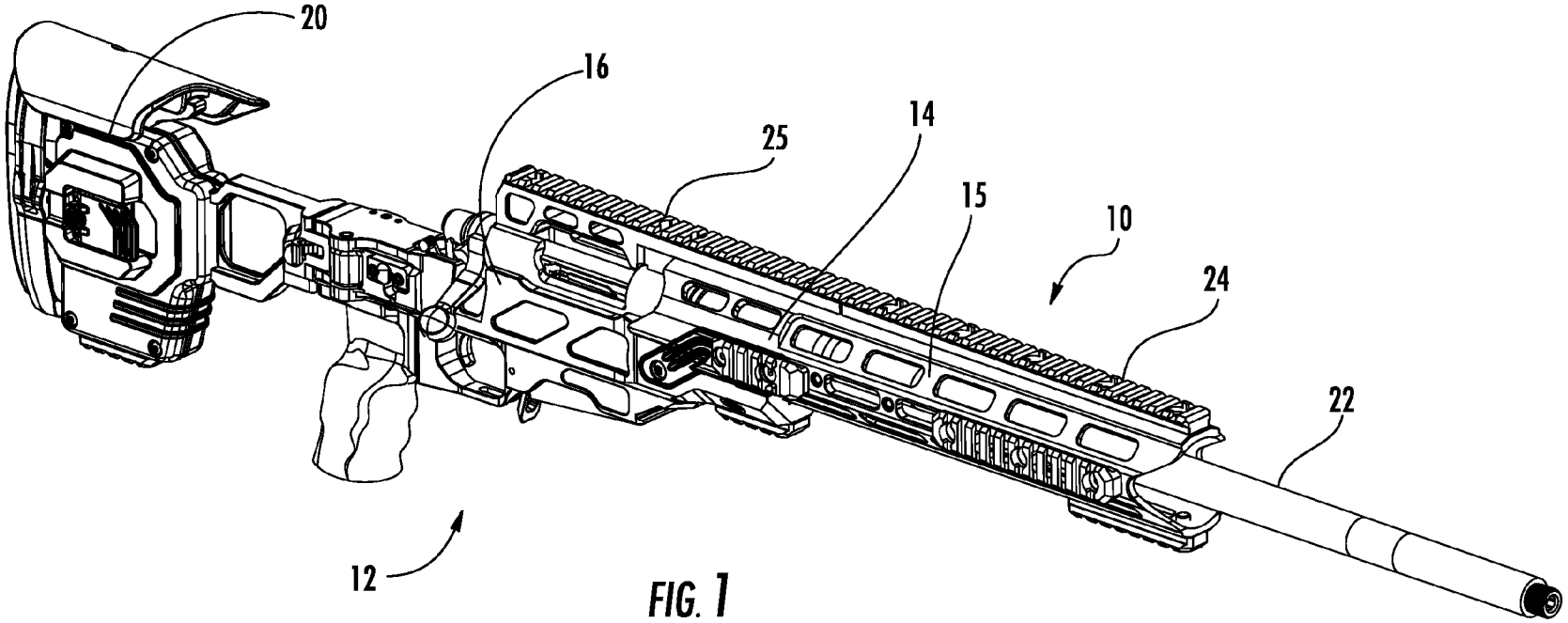
FIG. 1 is a perspective view of a first embodiment of the modular rail assembly mounted on a modular weapons platform.
Figure 2:
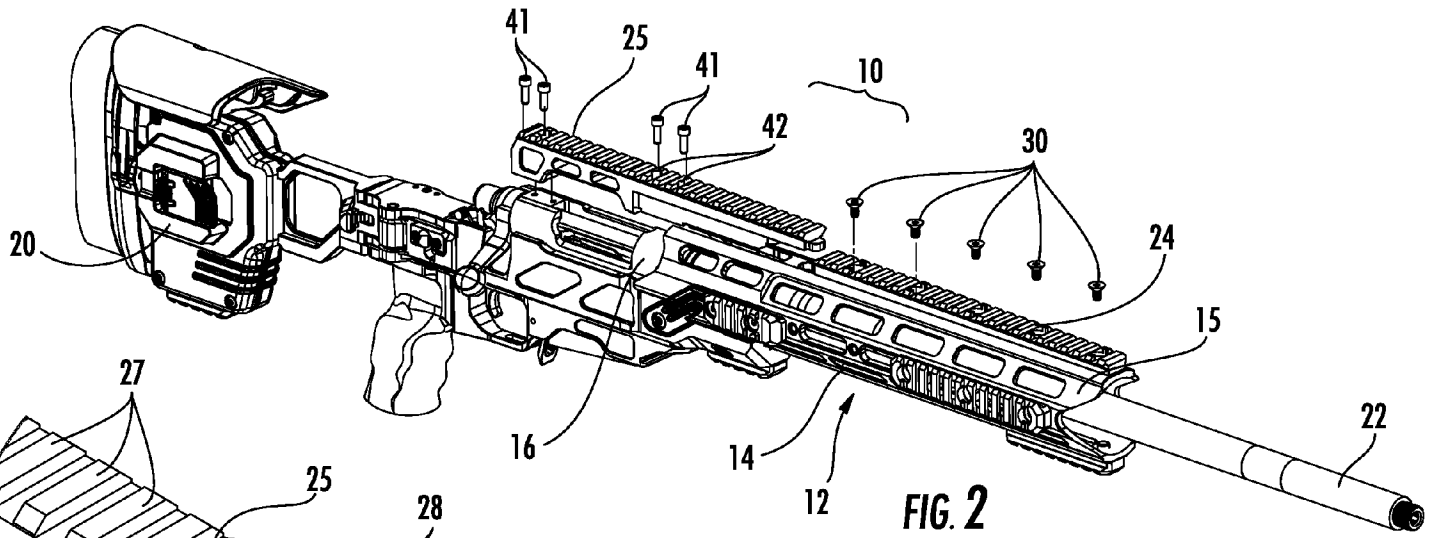
FIG. 2 is an exploded view of the modular rail assembly mounted on a modular weapons platform.

FIG. 1 illustrates the modular rail assembly 10 secured to the modular weapons platform 12 and FIG. 2 illustrates an exploded view of the modular rail assembly 10 juxtapositioned above the modular weapons platform 12. The modular weapons platform 12 includes a forestock assembly 14, including the foretube 15. The central receiver assembly 16 includes various components including a receiver, bolt action, trigger, and grip. The barrel 22 of the weapons platform extends through the foretube 15 in a free-floating arrangement. The aft end of the weapons platform 12 includes a buttstock assembly 20. As shown, the buttstock is an adjustable folding butt stock according to Applicants' prior patent which has been incorporated by reference above.

The receiver assembly 16 includes the bolt action and preferably can interface with numerous different actions. Alternatively, the receiver assembly 16 may be custom designed to interface with a particular action. The receiver assembly 16 can be selected based upon the action desired. The fore end of the receiver assembly 16 is coupled to the aft end of the forestock assembly 14 as will be described in more detail below. As such, the forestock assembly 14 can be easily substituted by users for different forestock assembly designs. Preferably, the connection between the forestock assembly 14 and the receiver assembly 16 enables the detachment of one from the other using hand tools. The buttstock assembly 20 couples to the aft end of the receiver assembly 16 and also is preferably easily detached from the receiver assembly 16 using relatively simple tools. Accordingly, the buttstock assembly 20, the receiver assembly 16 and the forestock assembly 14 may be changed to accommodate different barreled action, custom fit to the user's size or shooting preferences, or customized for particular tactical applications.

Figure 3:
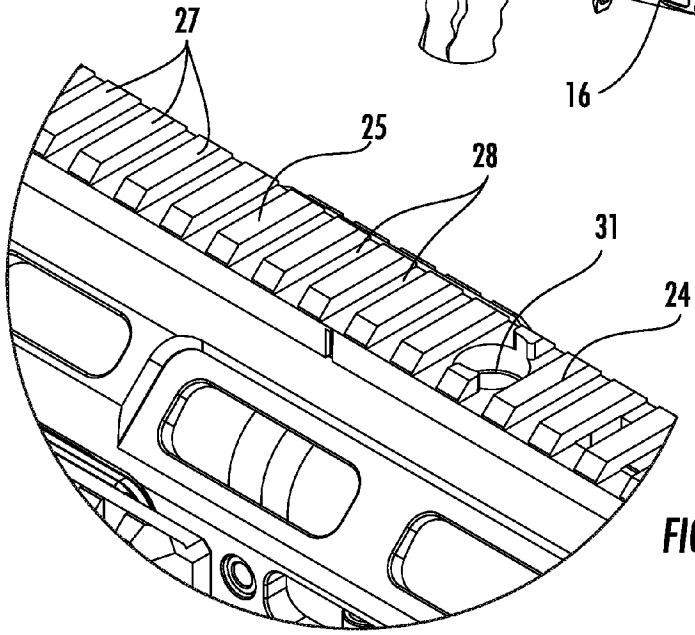
FIG. 3 is an enlarged perspective view of a portion of the modular rail assembly upper surface.

The modular rail assembly 10 includes a fore rail 24 and an aft rail 25. Preferably, each of the rails 24, 25 include an industry acceptable upper surface, such as a Picatinny type configuration, to support various accessories thereon. As shown in FIG. 3, each of the rails 24, 25 includes a plurality of ridges 27 defining spacing grooves 28 between adjacent ridges 27 so as to define a modular rail assembly with a Picatinny-style mounting surface.

The fore rail 24 is removably secured to the foretube 15 by at least one screw 30, and, as shown, more than one screw, for example, five screws. See FIGS. 4 and 5. Any number of screws 30 may be utilized without departing from the invention. The fore rail 24 defines apertures 31 which are preferably countersunk and configured for receipt of the screws 30. Preferably the number of countersunk apertures 31 corresponds to at least the number of screws 30 desired. As shown in FIG. 6, once assembled, the screw 30 is positioned within the countersunk aperture 31 within the fore rail 24 so as not to interfere with accessory mounting along the upper surface. Screws 30 are thereby secured through the fore rail 24 to the foretube 15 which also defines apertures 32 which correspond in number to at least the number of screws 30 desired. Preferably, these apertures 32 are threaded for securing the screws 30 therein. As such, the fore rail 24 is rigidly secured to the foretube 15.

Figure 4:
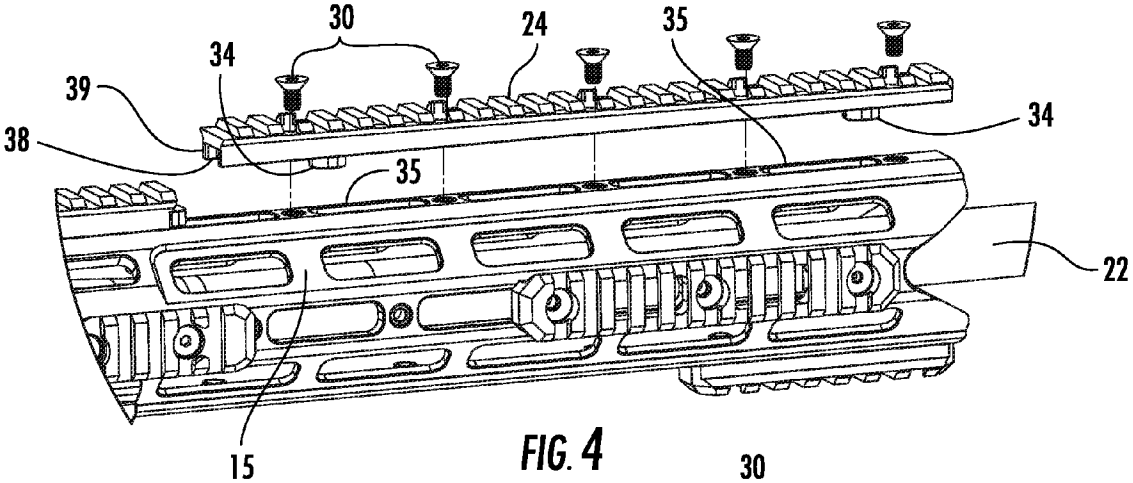
FIG. 4 is an exploded view of fore rail and the foretube.
Figure 5:
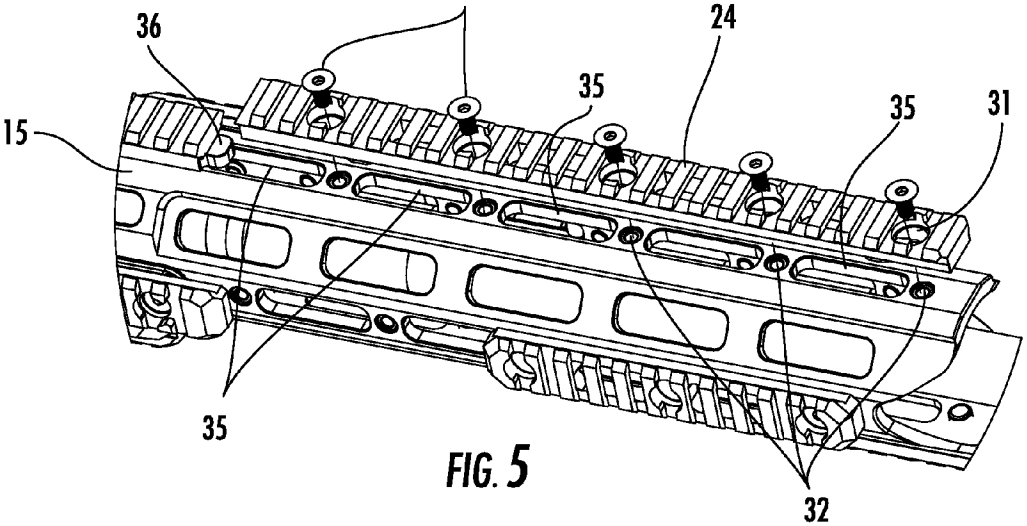
FIG. 5 is a an exploded view providing further illustration thereof.
Figure 6:
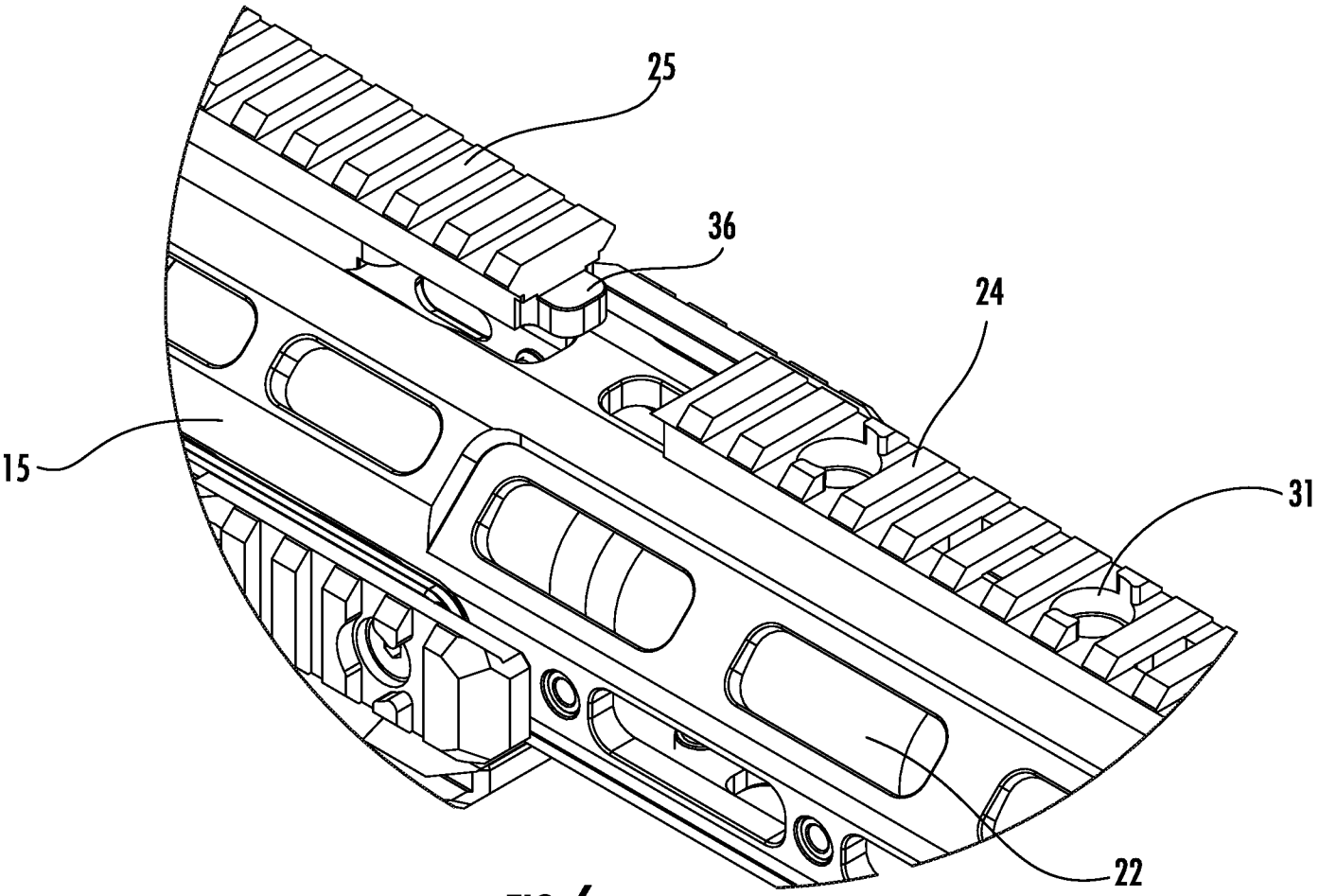
FIG. 6 is a perspective view, of the rail assembly illustrating the connection of the aft rail to the weapons platform and the fore rail.

Referring to the embodiment shown in FIGS. 4 and 5, guide members are shown in the form of at least one, and preferably two or more tabs 34 extending downward from the bottom surface of the fore rail 24. At least one, and preferably two or more, guides in the form of guide channels 35 are defined by the foretube 15 upper surface to assist in the proper alignment and placement of the fore rail 24. As best illustrated in FIGS. 4 and 5, the fore rail 24 is lowered upon the foretube 15 whereby the tabs 34 are positioned within the guide channels 35. As shown, the guide channels 35 are greater in length (in the longitudinal direction of the foretube 15) to accommodate placement of the tabs 34 within the guide channels 35 and permit the fore rail 24 to slide in the longitudinal direction until properly positioned. Once positioned, the countersunk apertures 31 of the fore rail 24 and the threaded apertures 32 of the foretube upper surface will be in alignment for receipt of each respective screw 30. As will be apparent, any number and arrangement of tabs 34 and guide channels 35, or size or shape of tabs 34 and guide channels 35, and any configuration of each may be provided so as to facilitate alignment of the fore rail 24 on the foretube 15 upper surface.

As shown in FIGS. 2, 4, 5, and 6, the aft rail 25 includes a first mating member 36 in the form of a pin extending outwardly from the fore end of the aft rail 25. See FIGS. 5 and 6. The mating member 36 in the form of a pin is configured to be received within a second mating member in the form of a mating channel 38 defined by the bottom surface of the fore rail 24. The mating channel 38, shown best in FIG. 4, is defined by "cutout" portion of the bottom surface of the rear portion of the fore rail 24 and a pair of vertically and downwardly extending side flanges 39. The mating channel 38 of the fore rail 24 facilitates the alignment of the aft rail 25 for cooperation with the fore rail 24.

Figure 7:
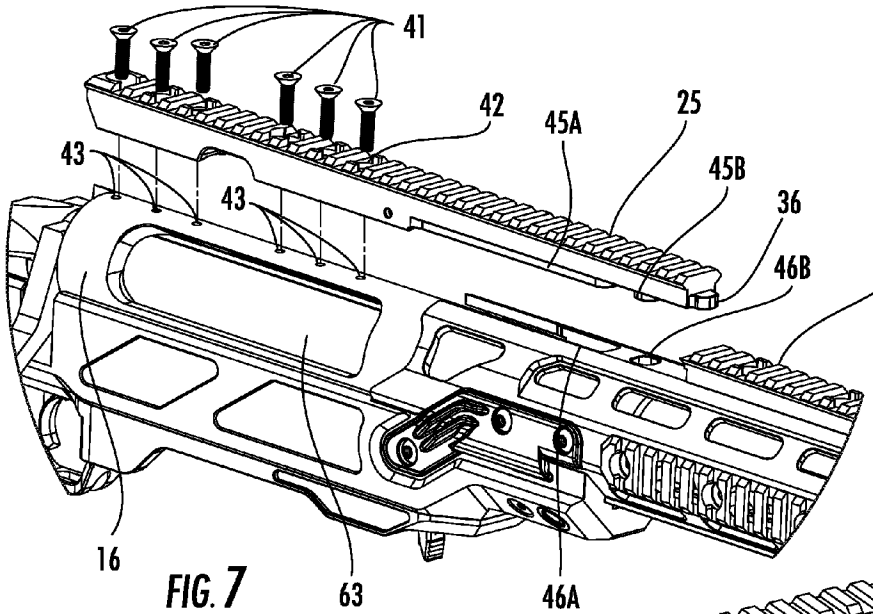
FIG. 7 is an exploded view illustrating the cooperation of the aft rail to the receiver assembly and the fore rail.
Figure 8:
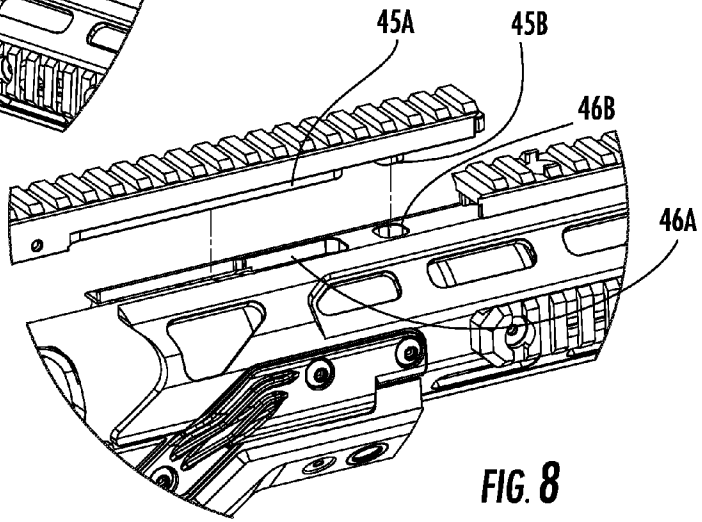
FIG. 8 is an enlarged, exploded view providing further illustration thereof.

More specifically, with reference to FIGS. 2, 7, and 8 the aft rail 25 is removably secured to the receiver assembly 16 by a plurality of screws 41 which are received within apertures 42 defined by the aft rail 25. The top surface of the receiver 16, above the bolt action ejection port 63 defines a plurality of threaded apertures 43 configured to receive the screws 41. The apertures 42 are preferably countersunk within the aft rail 25 so that the screws 41 do not interfere with accessories mounted on the rail.

Guide members are also provided on the aft rail 25. As best illustrated in FIGS. 7 and 8, a tab 45A extends a substantial portion of the length of, and protrudes downward from, the bottom side of the aft rail 25 which tab is designed to fit within the guide channel 46A defined by the aft end of the top surface of the foretube 15 for the purpose of receiving within such guide channel 46A the tab 45A. Depending on the caliber of the rifle the chassis is designed to accommodate, an additional single tab 45B may be included and which such tab 45B is designed to extend downward from the bottom surface of the aft rail 25 in front of the long tab 45A and which tab 45B is designed to fit within the single guide 46B located on the top surface of the foretube in front of the guide channel 46A. The tab 45A (and as applicable tab 45B) is configured to cooperate with the guide channel 46A (and as applicable the single guide 46B) to enable proper alignment of the aft rail 25 on the receiver assembly 16 and the fore rail 24 on the foretube 15. The tab 45A (and as applicable tab 45B), guide channel 46A (and as applicable the single guide 46B), and the mating members consisting of the pin 36 and mating channel 38 are configured to provide sufficient tolerances for easy interchangeability and for providing substantially rigid connections once secured. While not intending to be bound by any particular theory, it is believed that the unique cooperation between the pin 36 with the mating channel 38 achieves the benefit of downward pressure applied to the rail with the mating channel 38 further providing a substantially rigid modular rail assembly 10. Preferably, and as shown, the aft rail 25 therefore cooperates with the fore rail 24 and the foretube 15, but is not affixed (e.g., rigidly secured) thereto.

Figure 9:
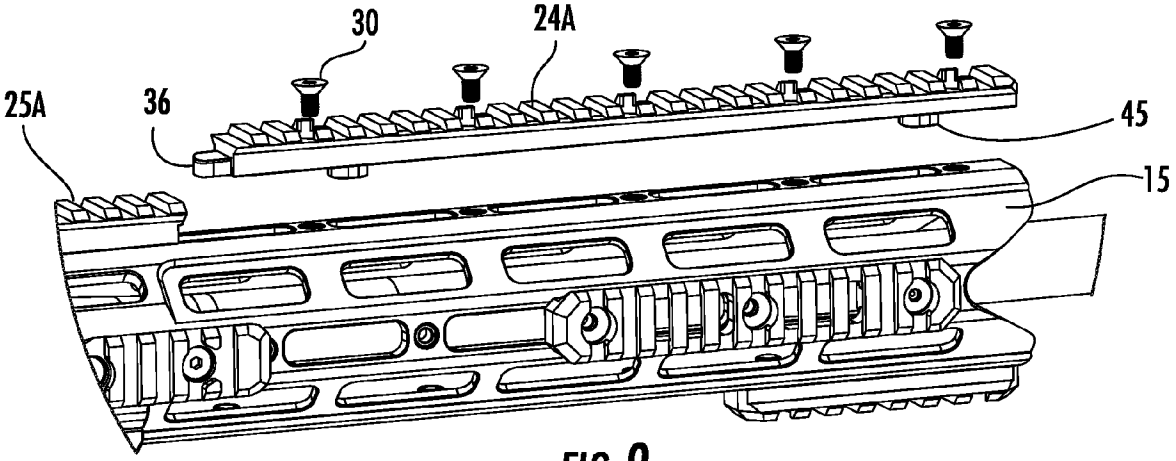
FIG. 9 is an exploded view of a second embodiment of the present invention illustrating an alternative cooperation between the rails of the rails assembly.
Figure 10:
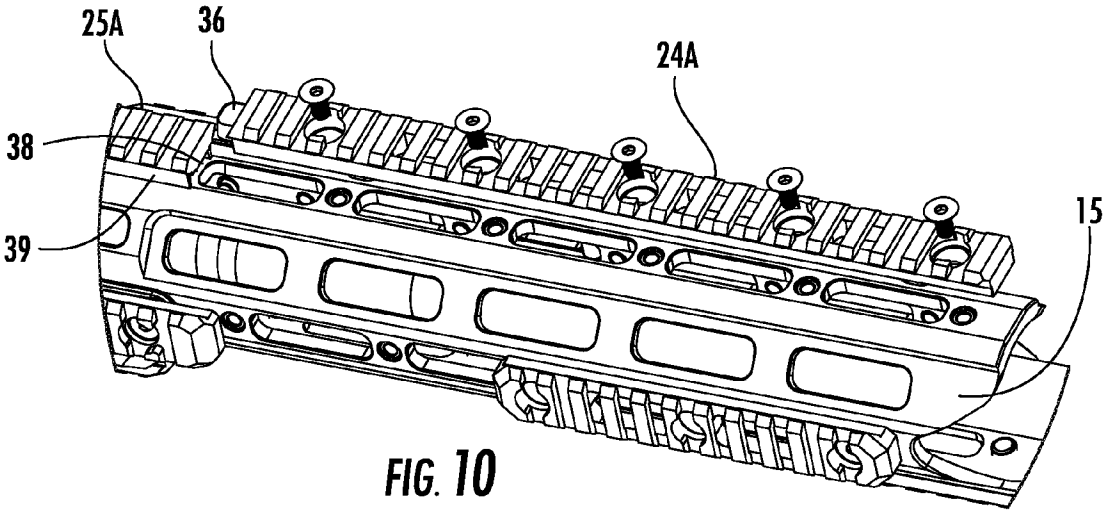
FIG. 10 is a further illustration thereof.

An alternative embodiment is illustrated in FIGS. 9 and 10. According to this second embodiment, the fore rail 24A includes the mating pin 36 and the aft rail 25A includes, along its bottom surface, the mating channel 38 as further defined by flanges 39. According to this embodiment as well, the aft rail also is not affixed to the foretube 15 (e.g., rigidly secured thereto)

Figures 11, 12:
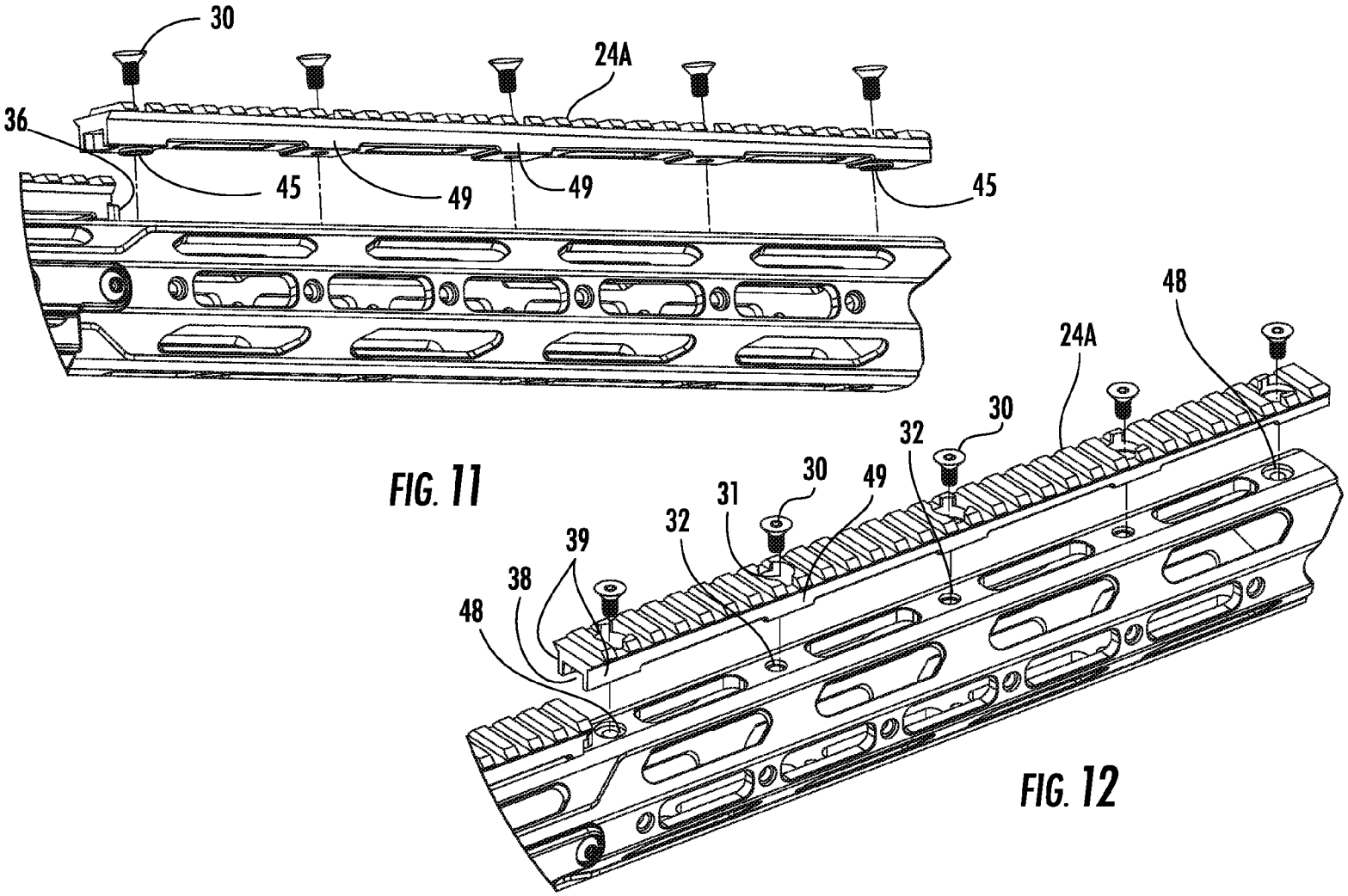
FIG. 11 is an exploded view of an alternative embodiment of the rail assembly illustrating an alternative connection of the rail to the foretube of the weapons platform.
FIG. 12 is a further illustration thereof.

An alternative embodiment of the means for mounting the fore rail to the foretube as described above is illustrated in FIGS. 11 and 12 and can be used in connection with the first or second embodiments previously described and may be positioned on either or both the fore and/or aft rails. According to this embodiment, the fore rail 24A includes at least one and, as shown, a plurality of supports 49 for positioning the fore rail 24A on the foretube 15. These supports 49 may optionally be provided in any number; however, five are shown in FIGS. 11 and 12. Supports 49 may optionally be positioned at any location along the length of the fore rail 24A, but as shown are positioned below the countersunk apertures 31 through which screws 30 engage. Supports 49 may be of numerous configurations as well.

At least one tab 45, and as shown in FIGS. 9 and 10, preferably more than one tab 45, also extend from the bottom surface of the fore rail 24A. The tabs 45 facilitate proper positioning of the fore rail 24A on the foretube 15 for proper alignment with the aft rail 25A. At least a corresponding number of seats 48 are provided on or defined by the foretube 15 and which are configured for receipt of the respective tabs 45. As such, the fore rail 24A is positioned on the foretube 15 so as to cooperate with the mating member 36 of the aft rail 35A. As to the first embodiment, illustrated in FIGS. 1-8, the aft rail 25 may similarly include at least one or a plurality of tabs 45 for seating within seat 48 on the foretube. See FIG. 8, for example. According to the second embodiment, the fore rail 24A and aft rail 25A are reversed with respect to the aft rail 25A which includes the tab or tabs 45 and the rear portion of the foretube 15 which defines the seat or seats 48. The rails are also reversed with respect to the aft rail 25A including the mating member 36 and the fore rail 24A defining the mating channel 38. As such, downward pressure is applied to the fore rail 24A by the aft rail 25A. For maximum customization and flexibility, the foretube 15 may be provided with seats 48 to accommodate any combination of the aft 24 or 24A and fore 25 or 25A rails.

Figure 13:
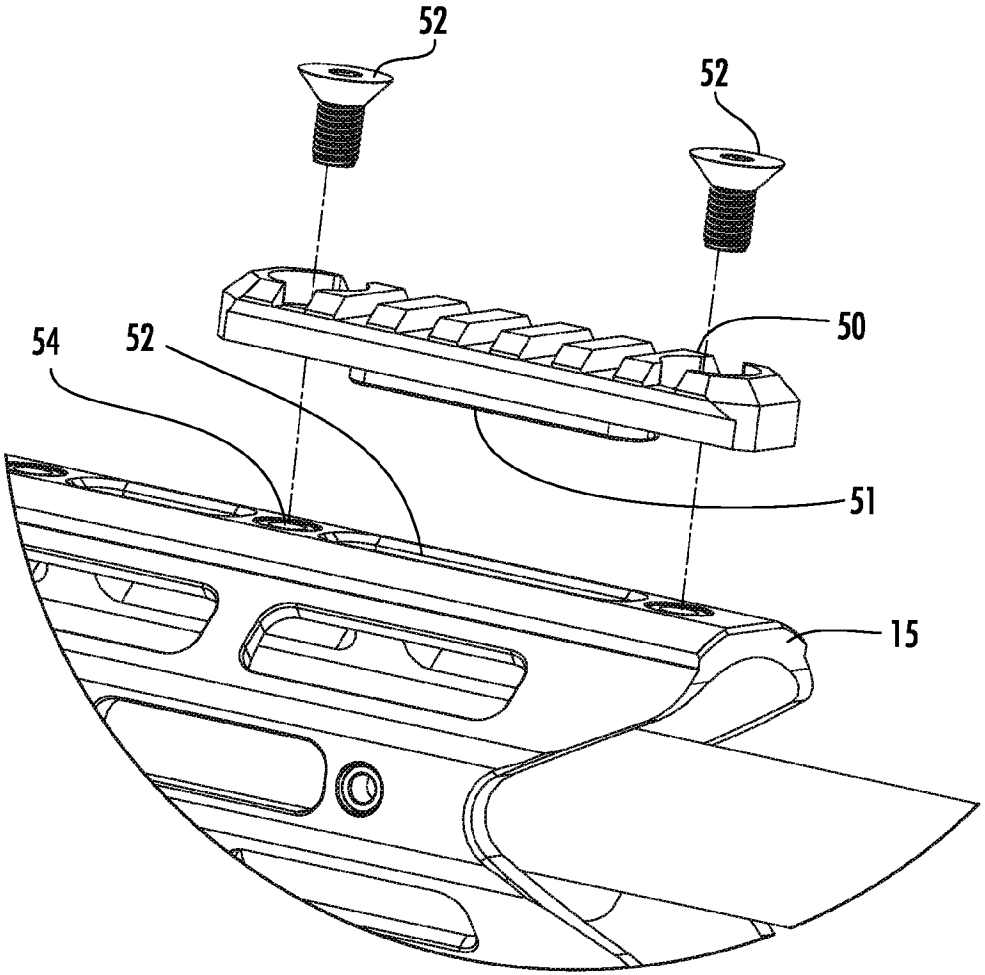
FIG. 13 is an enlarged perspective view of a third embodiment including a short rail portion of the modular rail assembly.

A third alternative embodiment is illustrated in FIG. 13. According to this embodiment, the rail assembly 10 includes a fore rail 50 which is relatively shorter than the previously described embodiments. The fore rail 50 includes at least one, and as shown, only one, tab 51 which preferably extends a substantial portion of the length of, and protrudes downward from, the shortened fore rail 50, at least one-third its length and preferably at least half its length. The foretube 15 includes correspondingly configured mating channel 51 for receipt of the tab 51. At least one, and preferably a pair of screws 52, extend through correspondingly configured countersunk apertures 54 defined by the fore rail 50. The foretube 15 defines at least a corresponding number of threaded apertures 54 for receipt of the respective screws 52. Preferably, the foretube apertures 54 are threaded for rigidly connecting the rail 50 to the foretube 15. The fore rail 50 may be used with or without an aft rail 25. When used with an aft rail 25, it is preferably positioned along the forestock assembly at a location distant from the aft rail 25 meaning that the rails would not directly connect.

An advantageous feature of the modular rail assembly 10 is that it further facilitates customization of the modular weapons platform 12. The modular weapons platform 12 enables complete customization in that its components, including the barrel, the action, the receiver, the trigger, the grip, the butt stock, etc. are each interchangeable. As described above and as shown in the various Figures, the modular rail assembly includes two rails, an aft and fore rail, but it is within the scope of the present invention to provide at least two rails, one positioned aft of the other. Any number of intermediate or appended rails may also be employed without departing from the spirit and scope of the present invention. Any one or more of the rails of the rail assembly may be substantially permanently affixed to, that is not readily removed, or integral to a portion of the weapons platform. For example, the aft rail (according to any embodiments disclosed herein) may be substantially rigidly connected to the receiver of the weapons platform or integral therewith and configured to cooperate with the modular fore rail, or vice versa. As such, the modularity is achieved by the removable fore rail (or aft rail in the alternative). Moreover, use of the modular rail assembly 10 according to the present invention provides a weapons platform 12 which can accommodate foretubes 15 of different lengths. For example, a long foretube 15 (FIG. 14B) can be provided to the user with a short foretube 15A (FIG. 14A) and the two can be interchangeable while utilizing the same rail assembly 10 or a portion thereof.

Figure 14A:
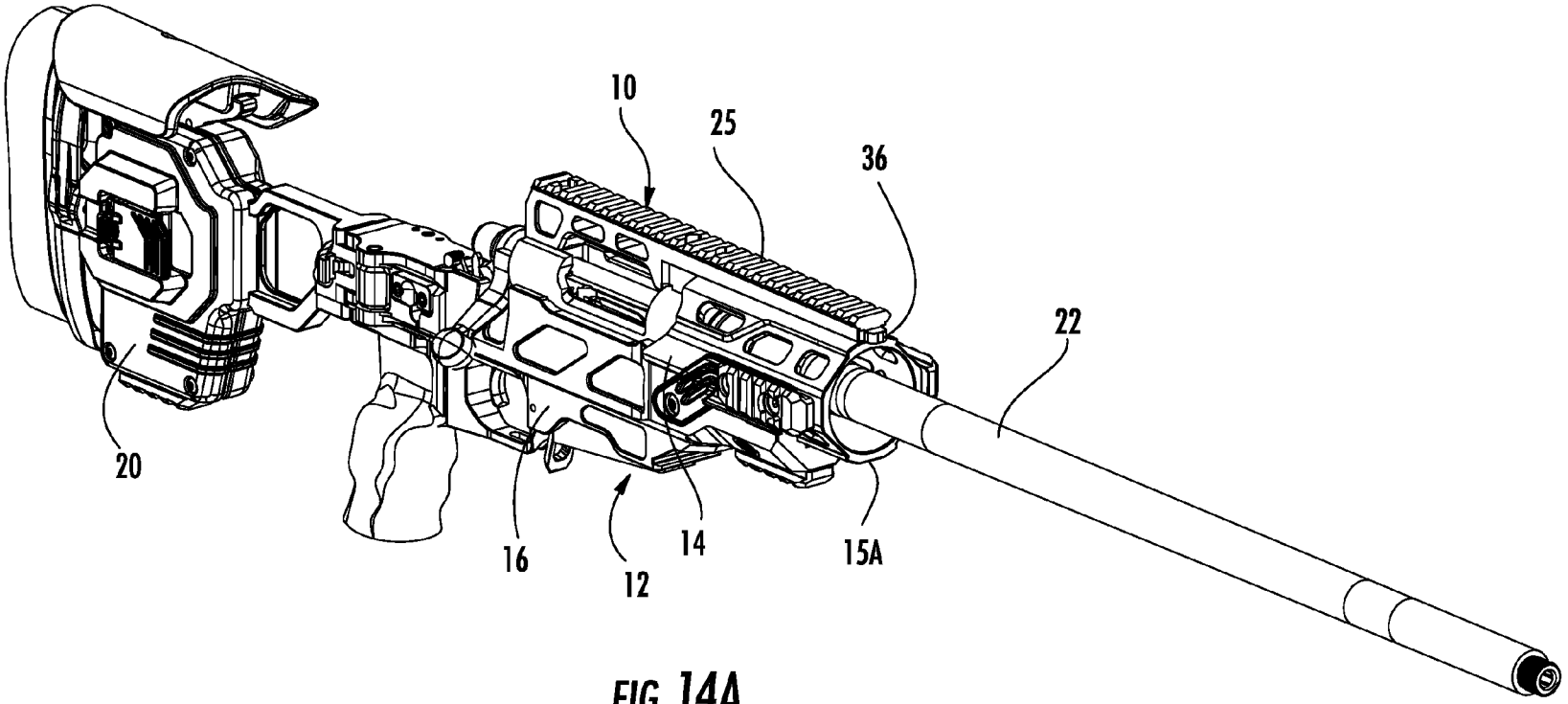
FIG. 14A is a perspective view of the modular rail assembly on a modular weapons platform having a short tube.
Figure 14B:
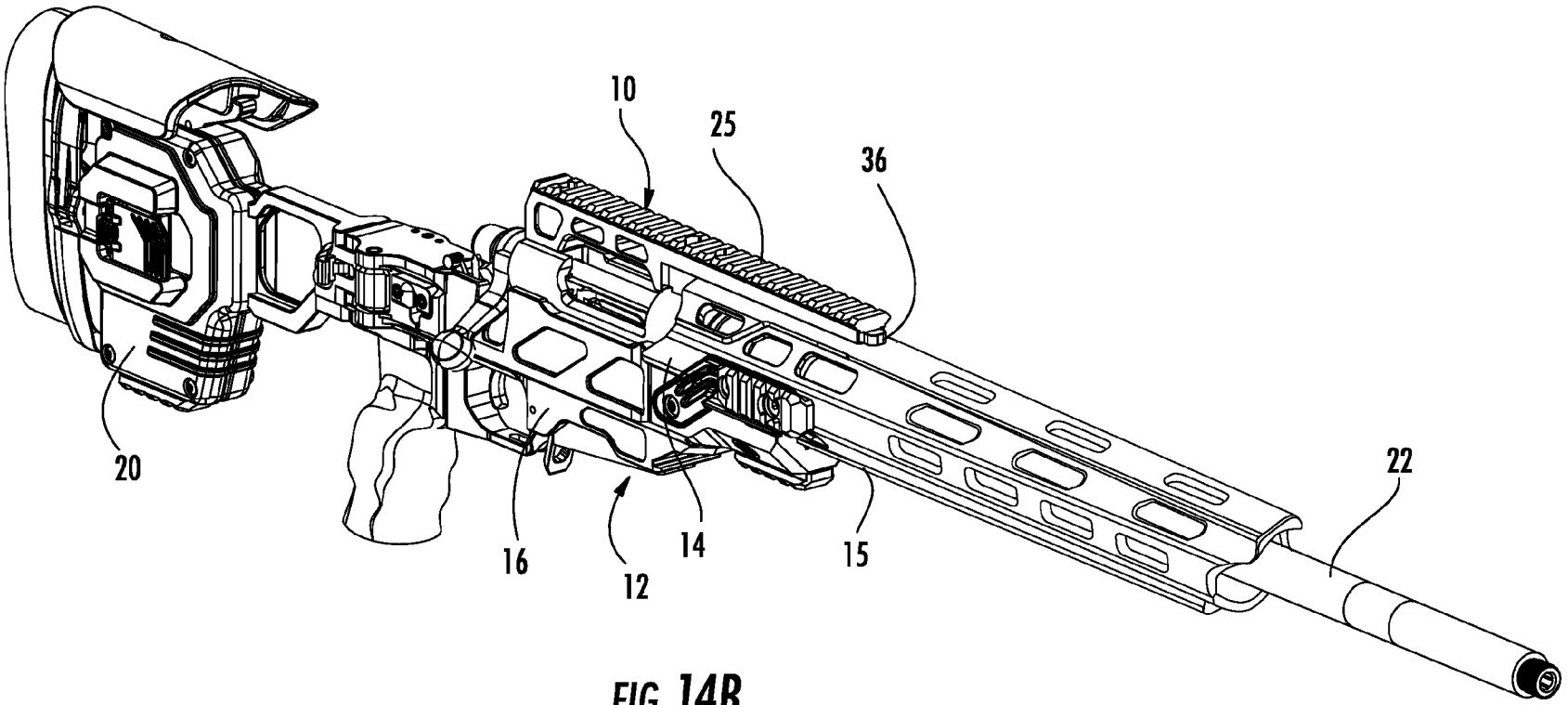
FIG. 14B is a perspective view of the modular rail assembly on a modular weapons platform having a long tube.

FIGS. 14A and 14B illustrate a modular rail assembly 10 including only one of the rails, the aft rail 25. The aft rail 25 is secured to the receiver and receiver assembly 16 according to any of the embodiments discussed above. As shown, the aft rail 25 includes the mating pin 36, but it is to be understood that the aft rail 25 may alternatively include a mating channel as discussed above regarding the second embodiment) or neither. This provides the advantageous flexibility of removing the long foretube 15 (shown in various Figures), and replacing it with a short foretube 15A shown in FIG. 14. This is accomplished by removing brackets 58 (located at 90° and 270° as measured from the top or 0° position) that join to the side of the receiver assembly and the side of the foretube, then removing the long foretube 15 and replacing the long foretube 15 with the short foretube 15A. The aft rail 25 remains in place and intact thereby not imparting changes to a scope or other accessory mounted on the aft rail 25. Moreover, the interchangeability of the foretube (that is, foretubes of different lengths and/or configurations) is further facilitated by the aft rail 25 configuration wherein the aft rail is not affixed to the foretube allowing easy removal of the foretube. Rather, and as shown, the aft rail 25 merely extends above and along the length of the upper surface of the foretube. (It should be appreciated that the aft rail 25 may also possess a length wherein it does not extend substantially over the foretube.)

Figure 15:
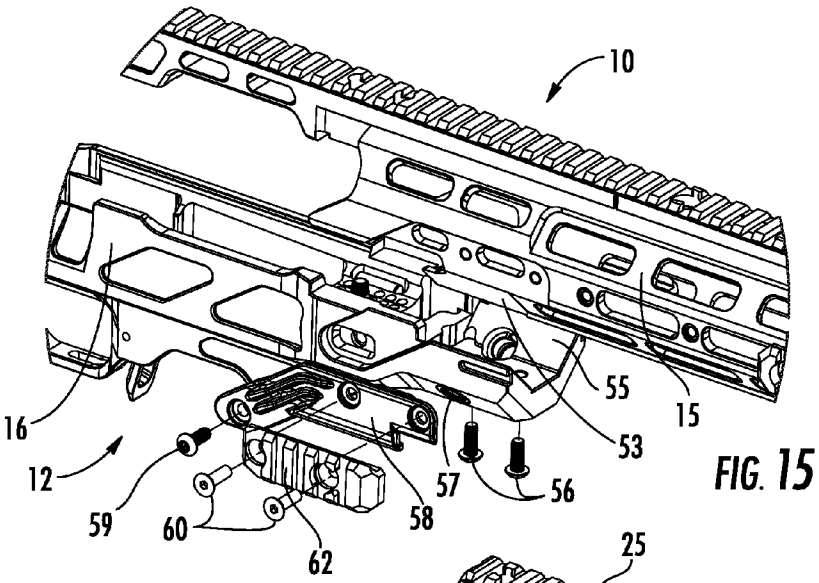
FIG. 15 is an exploded view illustrating the connection of the foretube to the receiver portion of the modular weapons platform according to each of the embodiments of the present invention.
Figure 16:
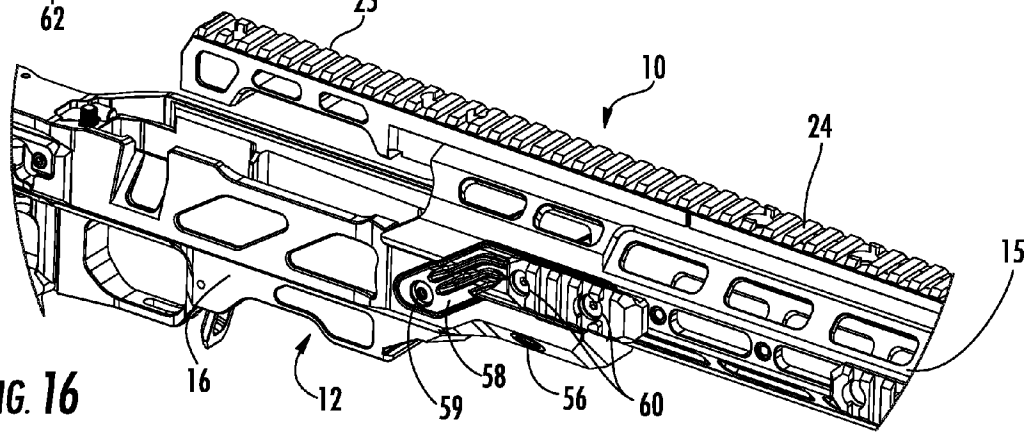
FIG. 16 is a perspective view thereof.

The modular weapons platform includes a unique configuration for securing the foretube 15, 15A to the receiver assembly 16 to facilitate the aforementioned customizable features of the present invention. The foretube 15, 15A includes a bottom surface configured to cooperate with an upwardly facing surface of the receiver assembly 16. More specifically, the foretube bottom surface (at 180° as measured from the top or 0° position) includes flat or planar surfaces 53 as shown in FIG. 15. These correspond in configuration to planar surfaces 55 defined by the receiver assembly 16. The surfaces 55 of the receiver assembly 16 receive the foretube planar surfaces 55 as shown in FIG. 16. The foretube 15, 15A and receiver assembly 16 are secured underneath by at least one, and as shown, a pair of screws 56 which extend through countersunk apertures 57 of the receiver assembly planar surface 55 and apertures of the foretube planar surfaces 53. Preferably, the foretube planar surface apertures are threaded.

The foretube 15, 15A and the receiver assembly 16 are secured along sides thereof by at least one, and preferably a pair, of brackets 58 located on opposing sides thereof. The bracket 58 is secured to the receiver assembly by at least one screw 59 which secures the bracket 58 to the receiver assembly 16. At least one, and as shown two screws 60, secure the upper end of the bracket 58 to the foretube 15, 15A. This provides a rigid connection between the receiver assembly 16 and the foretube 15, 15A along side surfaces thereof. Optionally, a side rail 62 may also be included on the bracket 58 to provide additional accessory mounting thereon. As seen in the various Figures, additional rails 62 may be added to the modular weapons platform at various positions.

In the drawings and the specification, there has been set forth preferred embodiments of the invention and, although specific terms are employed, the terms are used in a generic and descriptive sense only and not for the purpose of limitation, the scope of the invention being set forth in the following claims.

What is claimed:

1. A modular weapons platform comprising:

a central receiver assembly, a butt stock assembly connected to an aft end of said central receiver assembly, a forestock assembly connected to a fore end of said central receiver assembly, said forestock assembly comprising a foretube; and a modular rail assembly connected to a top surface of said central receiver assembly wherein said modular rail assembly comprises an aft rail including a top surface configured to interface with an accessory and which extends along a top surface of and is rigidly connected to said receiver assembly and which extends above and along a top surface of said foretube of said forestock assembly wherein said aft rail is not directly fastened to said foretube and said aft rail is configured so that the foretube may be removed independently of said aft rail.

2. A modular weapons platform according to claim 1 wherein said modular rail assembly further comprises a fore rail which extends along a top surface of and is rigidly connected to a top surface of said foretube.

3. A modular weapons platform according to claim 2 wherein said aft rail and said fore rail are removeably connected to one another along end surfaces thereof.

4. A modular weapons platform according to claim 3 wherein said aft rail defines a mating member on its fore end and said fore rail defines a mating member on its aft end for cooperating with said aft rail mating member.

5. A modular weapons platform according to claim 4 wherein said aft rail mating member is a tab and said fore rail mating member is a mating receptacle defined by said aft end of said fore rail configured to removeably receive said aft rail tab.

6. A modular weapons platform according to claim 5 wherein said mating receptacle is a channel defined by downwardly extending side flanges of said fore rail.

7. A modular weapons platform according to claim 5 wherein said tab is an outwardly extending tab extending from said fore end of said aft rail.

8. A modular weapons platform according to claim 4 wherein said fore rail mating member is a tab and said aft rail mating member is a mating receptacle configured to removeably receive said fore rail tab.

9. A modular weapons platform according to claim 8 wherein said mating receptacle is a channel defined by downwardly extending side flanges of said aft rail.

10. A modular weapons platform according to claim 8 wherein said tab is an outwardly extending tab extending from said aft end of said fore rail.

11. A modular weapons platform according to claim 2 wherein said fore rail includes a guide member and said foretube assembly includes a guide for cooperating with said guide member to facilitate alignment of said fore rail to said foretube assembly.

12. A modular weapons platform according to claim 11 wherein said guide member includes at least one downwardly extending tab and said guide is a guide channel configured to receive said tab.

13. A modular weapons platform according to claim 12 wherein at least two tabs are provided along the bottom surface of said fore rail and said forestock assembly includes at least two guides for receipt of said at least two tabs.

14. A modular weapons platform according to claim 2 wherein said fore rail is positioned along said foretube at a location distanced from said aft rail.

15. A modular weapons platform according to claim 2 wherein said fore end of said central receiver assembly includes a receiving surface which is matingly configured to receive an aft end of said foretube of said forestock assembly and a securing member for rigidly connecting bottom surfaces of said forestock and receiver assemblies when said foretube is received within said receiver assembly receiving surface.

16. A modular weapons platform according to claim 15 wherein said receiving surface is defined by at least one substantially planar surface and said aft end of said foretube includes at least one substantially planar surface.

17. A modular weapons platform according to claim 16 wherein said planar surfaces of said receiver assembly and said foretube each include a substantially horizontal planar surface along bottoms thereof and two planar surfaces positioned at obtuse angles to said horizontal planar surface and extending upwardly from sides of said horizontal planar surfaces.

18. A modular weapons platform according to claim 15 wherein said securing member comprises at least one screw which extends substantially through said receiver receiving surface and said aft end of said foretube received in said receiving surface.

19. A modular weapons platform according to claim 1 wherein a bottom surface of said aft rail includes a guide member and said top surface of said receiver assembly includes a guide for cooperating with said guide member to facilitate alignment of said aft rail to said receiver assembly.

20. A modular weapons platform according to claim 19 wherein said guide member includes at least one downwardly extending tab and said receiver assembly guide is a guide channel configured to receive said tab.

21. A modular weapons platform according to claim 20 wherein at least two tabs are provided along the bottom surface of said aft rail and said receiver assembly includes at least two guides for receipt of said at least two tabs.

22. A modular weapons platform according to claim 1 further comprising at least one bracket secured to a surface of said receiver assembly and said forestock assembly, said surface being a surface other than a top surface of said receiver and forestock assemblies to rigidly connect said assemblies.

23. A modular weapons platform according to claim 22 wherein said at least one bracket secures a side surface of said receiver assembly and said forestock assembly.

24. A modular weapons platform according to claim 23 wherein said at least one bracket is non-linear in configuration.

25. A modular weapons platform according to claim 23 wherein at least two of said brackets are provided and are positioned on substantially opposing side surfaces of said receiver and forestock assemblies to rigidly connect said assemblies.

26. A modular weapons platform according to claim 23 wherein a side rail having a surface configured to interface with an accessory is secured to said at least one bracket.

27. A modular weapons platform according to claim 1 further comprising securing members for rigidly connecting said fore rail to said foretube.

28. A modular weapons platform according to claim 1 further comprising securing members for rigidly connecting said aft rail to said receiver assembly.

29. A modular weapons platform comprising:

a central receiver assembly, a butt stock assembly connected to an aft end of said central receiver assembly, a forestock assembly connected to a fore end of said central receiver assembly, said forestock assembly comprising a foretube; and a modular rail assembly extending along a top surface of said central receiver assembly and said foretube assembly wherein said modular rail assembly comprises: an aft rail including a top surface configured to interface with an accessory which extends along a top surface of said receiver and is rigidly connected to said receiver assembly and which extends above and along a top surface of said foretube wherein said aft rail is not directly fastened to said foretube, wherein said aft rail is configured so that the foretube may be removed independently of said aft rail; and a fore rail including a top surface configured to interface with an accessory which extends along and is rigidly secured to a top surface of said forestock assembly wherein a fore end of said aft rail includes a first mating member and an aft end of said fore rail includes a second mating member wherein said mating members cooperate with one another to directly connect the aft and fore rails and wherein one of said mating members is a receptacle for receiving said mating member of the other of said rails.

30. A modular weapons platform according to claim 29 wherein said aft rail mating member is a tab extending from said fore end of said aft rail and said fore rail mating member is a mating receptacle defined by said aft end of said fore rail configured to removeably receive said aft rail tab.

31. A modular weapons platform according to claim 30 wherein said mating receptacle is a channel defined by downwardly extending side flanges of said fore rail.

32. A modular weapons platform according to claim 29 wherein said fore rail mating member is a tab extending from an aft end of said fore rail and said aft rail mating member is a mating receptacle defined by said fore end of said aft rail and is configured to removeably receive said fore rail tab.

33. A modular weapons platform according to claim 32 wherein said tab is an outwardly extending tab extending from said aft end of said fore rail.

34. A modular weapons platform according to claim 29 wherein said mating receptacle is a channel defined by downwardly extending side flanges of said aft rail.

35. A modular weapons platform according to claim 29 wherein a bottom surface of said aft rail includes a guide member and said top surface of said receiver assembly includes a guide for cooperating with said guide member to facilitate alignment of said aft rail to said receiver assembly.

36. A modular weapons platform according to claim 35 wherein said guide member includes at least one downwardly extending tab and said receiver assembly guide is a guide channel configured to receive said tab.

37. A modular weapons platform according to claim 36 wherein at least two tabs are provided along the bottom surface of said aft rail and said receiver assembly includes at least two guides for receipt of said at least two tabs.

38. A modular weapons platform according to claim 29 wherein said fore rail includes a guide member and said foretube assembly includes a guide for cooperating with said guide member to facilitate alignment of said fore rail to said foretube assembly.

39. A modular weapons platform according to claim 38 wherein said guide member includes at least one downwardly extending tab and said guide is a guide channel configured to receive said tab.

40. A modular weapons platform according to claim 39 wherein at least two tabs are provided along the bottom surface of said fore rail and said forestock assembly includes at least two guides for receipt of said at least two tabs.

41. A modular weapons platform according to claim 29 further comprising at least one bracket secured to a surface of said receiver assembly and said forestock assembly, said surface being a surface other than a top surface of said receiver and forestock assemblies to rigidly connect said assemblies.

42. A modular weapons platform according to claim 41 wherein said at least one bracket secures a side surface of said receiver assembly and said forestock assembly.

43. A modular weapons platform according to claim 42 wherein said at least one bracket is non-linear in configuration.

44. A modular weapons platform according to claim 42 wherein at least two of said brackets are provided and are positioned on substantially opposing side surfaces of said receiver and forestock assemblies to rigidly connect said assemblies.

45. A modular weapons platform according to claim 42 wherein a side rail having a surface configured to interface with an accessory is secured to said at least one bracket.

46. A modular weapons platform according to claim 29 wherein said fore end of said central receiver assembly includes a receiving surface which is matingly configured to receive an aft end of said foretube of said forestock assembly and a securing member for rigidly connecting bottom surfaces of said forestock and receiver assemblies when said foretube is received within said receiver assembly receiving surface.

47. A modular weapons platform according to claim 46 wherein said receiving surface is defined by at least one substantially planar surface and said aft end of said foretube includes at least one substantially planar surface.

48. A modular weapons platform according to claim 47 wherein said planar surfaces of said receiver assembly and said foretube each include a substantially horizontal planar surface along bottoms thereof and two planar surfaces positioned at obtuse angles to said horizontal planar surface and extending upwardly from sides of said horizontal planar surfaces.

49. A modular weapons platform according to claim 46 wherein said securing member comprises at least one screw which extends substantially through said receiver receiving surface and said aft end of said foretube received in said receiving surface.

* * * * *